United States Patent [19]

Loveland et al.

[11] 4,028,865

[45] June 14, 1977

[54] CONTROL MECHANISM FOR CARTON SEALING MACHINE ELEVATOR HEAD

[75] Inventors: Winton Loveland, Fort Salonga; Horst J. Hanemann, Manhasset, both of N.Y.; Saul Warshaw, Hawley, Pa.

[73] Assignee: The Loveshaw Corporation, Deer Park, N.Y.

[22] Filed: Jan. 14, 1976

[21] Appl. No.: 648,916

[52] U.S. Cl. ..... 53/76
[51] Int. Cl.[2] ..... B65B 57/02
[58] Field of Search ..... 53/75, 76

[56] References Cited

UNITED STATES PATENTS

| | | | |
|---|---|---|---|
| 3,466,843 | 9/1969 | Mumper | 53/76 X |
| 3,502,256 | 3/1970 | Boulay et al. | 53/75 X |
| 3,505,774 | 4/1970 | Gidge | 53/75 X |

*Primary Examiner*—Travis S. McGehee

*Attorney, Agent, or Firm*—Watson Leavenworth Kelton & Taggart

[57] ABSTRACT

Tape sealing machine elevator head control equipment which avoids tipping up a loaded and tape-sealed carton as it is being advanced to the machine discharge end for withdrawal of its trailing end from beneath lowered and loading elevator head bearing down on this carton during the application of tape thereto. Powered means is provided to raise and lower the elevator head and to dictate the loading thereof down on the carton top as the carton is being advanced through the machine. There is also provided control means responsive to the forwardly traveling carton in the vicinity of the machine discharge end section to activate the powered means for raising the elevator head up from the carton top for a relatively short period of time sufficient to relieve the carton back end of the load of the head as this carton back end is withdrawn from therebeneath.

5 Claims, 5 Drawing Figures

CONTROL MECHANISM FOR CARTON SEALING MACHINE ELEVATOR HEAD

BACKGROUND AND SUMMARY

The present invention is concerned with mechanism in a machine for applying adhesive tape to cartons having their end and side flaps folded inward, to anchor those folded flaps securely. It is an old practice in the concerned art to provide such machines which receive from an operator's hands or equipment he controls cartons with their flaps folded over contained contents, and to apply to each carton adhesive or pressure sensitive tape for securely anchoring in closed positions the folded carton flaps. These machines are equipped with tape applying assembly units each of which frequently has two tape applicator rollers that are pivotally mounted for swing. In some the unit has a single first roller projecting into a path of transport of each carton through the machine and with this roller supporting an end of the tape with its adhesively coated face opposed to the leading end wall of the on-coming carton for adherence anchorage thereto. Then, as the carton advances, it swings this first applicator roller forward to lower it out of the way of the oncoming carton while wiping the adhesive tape to anchorage of carton surfaces, i.e., first a portion of the carton leading end wall surface, then along the longitudinal top (or bottom as the case may be) to lap the opposed edges of the infolded side flaps and finally to leave a trailing end section to lap up (or down as the case may be) against the trailing carton end wall by one of another pair of applicator rollers.

The pending U.S. patent application Ser. No. 645,718, filed Dec. 31, 1975 for Tape Appyling Mechanisms of Carton Sealing Machines, of Saul Warshaw, Winton Loveland, and Horst J. Hanemann discloses appreciable details of such a tape applying machine which is advantageously equipped with control mechanisms and sub-assemblies of the present invention to lower an elevator head thereof to a minimum elevation whereby its lateral head beam and a control carried by its back end are in the path of any advancing carton fed thereto to cause this head beam and control to rise enough for the advancing carton to be transported forward to beneath this beam and then the latter to move down to rest thereon for loading this advancing carton. That patent application also disclosed certain control means at the exit end of the machine which are here important to the present invention, and the disclosure thereof is embodied herein by reference.

It is an object of the present invention to provide such head raising and lowering mechanism which effectively loads each carton as it advances through the machine and then, uniquely, as the taped carton begins to exit from beneath the loading head beam for discharge from the machine this beam is raised momentarily to relieve the exiting carton from such load, thus avoiding any tendency of such loading on the back end of the carton as the latter moves from therebeneath of tipping up the carton and risking fall and damage thereof.

Another object of the invention is to provide control means at the exit end of the machine which permits in simple and effective manner each exiting carton to manipulate such control means effectively to cause the head beam unloading of this carton at the critical time.

A further object of the invention is to provide such control means in a form of a plurality of units successively arranged along the carton exiting path in close enough proximity whereby a first one may be manipulated by the advancing carton and thereafter the second may be manipulated by the further advanced carton while permitting intermediate manipulation of both simultaneously, all to attain successive machine parts operations in a very desirable and most logical order.

In accordance with the present invention a typical embodiment of the elevator head, the controlled operations thereof, and the actions of associated machine sub-assemblies may be embodied together in the machine to perform as follows. A loaded carton may be pushed by hand into the entry end of the machine and it will be abutted against a control on the lowered head beam to cause side rails to be moved in to opposite sides of the carton and then the head beam to be raised out of the path of the carton so that it can move forward toward abutment against the wipe-on tape applicator roller means. After adhesive tape has been applied longitudinally to the forwardly moving loaded carton, preferably medially up and down the leading and trailing end walls and along the opposed edges of the infolded top and bottom side flaps, while the head beam loads the top of the advancing carton, the taped carton arrives at the discharge end section of the machine there successively to trip controls which will raise the head beam from off of the carton top momentarily to unload it while the carton is discharged from the machine. Consequently, the series of loaded cartons exiting from the discharge end of the machine normally will transfer to receiving equipment, such as an end table, without tendency to be tipped or tumbled by otherwise existing head loading of the cartons' back ends.

Powered circuitry and equipment therein are embodied in the machine for performing all of the required operations in properly timed relation, and such may be embodied in a variety of types. For example, if such circuitry and equipment is of an electrical type, motive power therein may be electrical motive means, and controls therein may be photoelectric cells and relay switches responding thereto, or, as may be preferred, the circuitry and equipment may be of pneumatic type as is hereinafter more fully taught.

Other objects of the invention will in part be obvious and will in part appear from reference to the following detailed description taken in connection with the accompanying drawings, wherein like numerals identify similar parts throughout, and in which.

Figure 2:
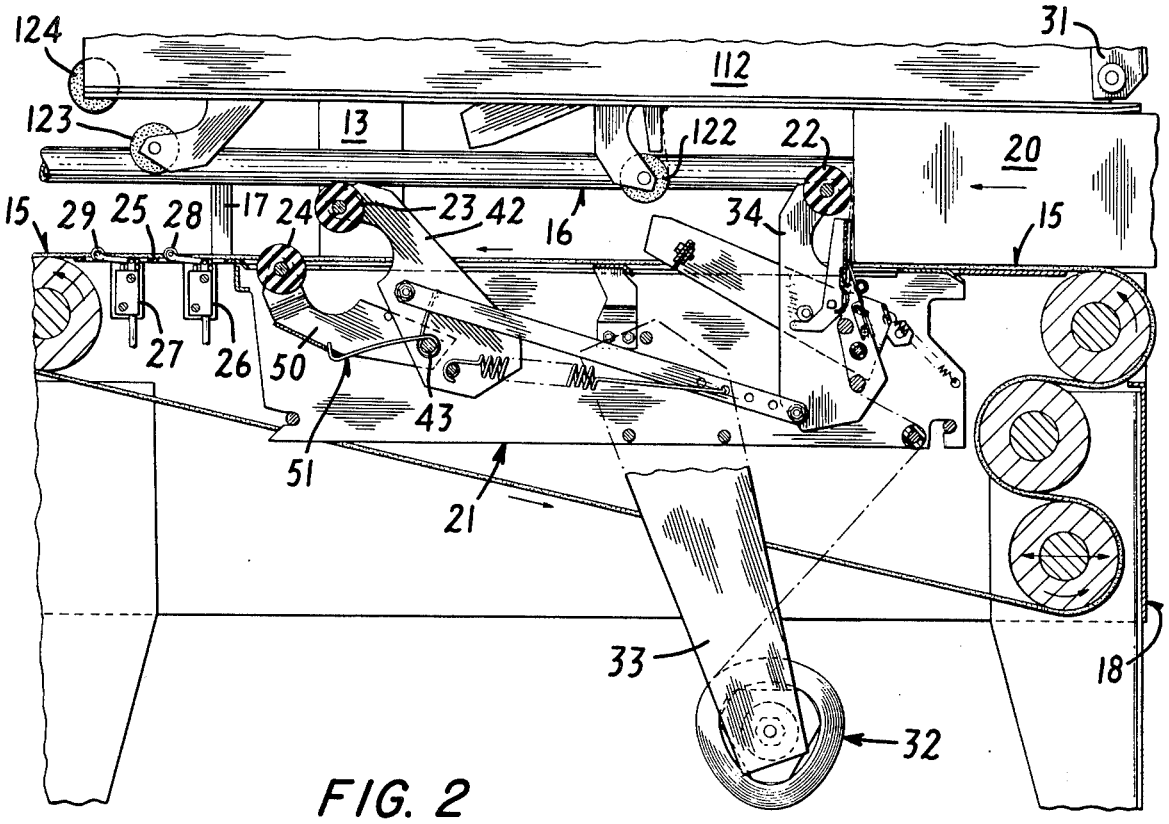
FIG. 2 is an elevational sectional view to larger scale, with parts broken away, of the machine showing a portion of a loaded carton advancing therethrough toward pneumatic control mechanisms at the discharge end of the machine.
Figure 4:
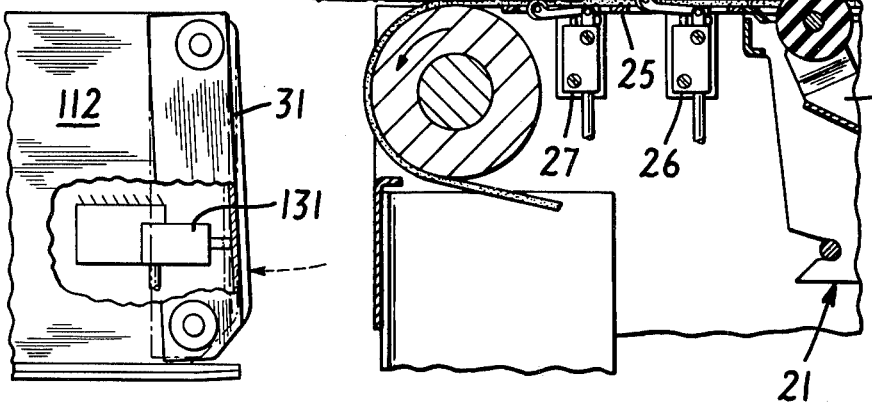
Figure 5:
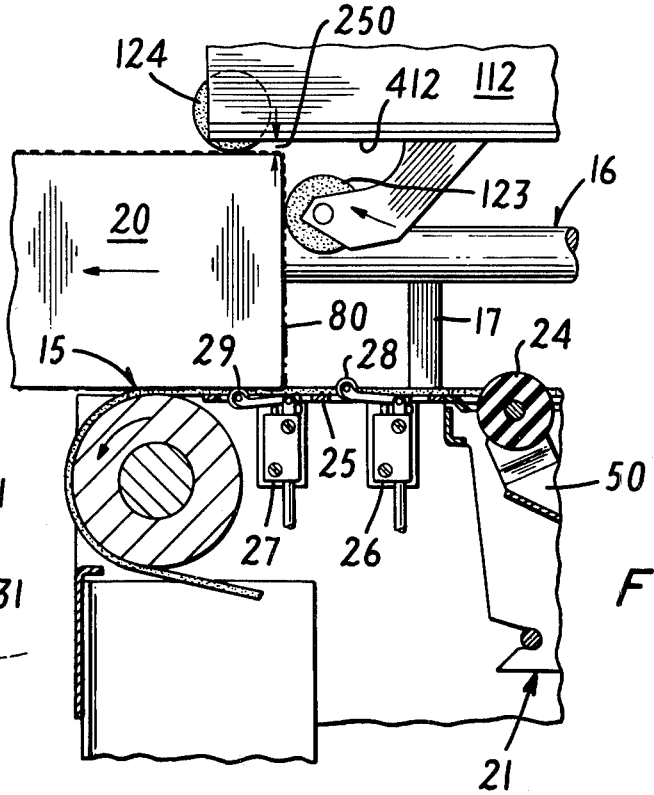

FIG. 4 is an elevational detail, with parts broken away and in section, of the approach end of the head beam of the machine showing a pneumatic valve located behind the carton contacting manipulator so that the latter will operate it; and FIG. 5 is an elevational detail, with parts broken away and in section, of a portion of the left side of FIG. 2 illustrating manipulation of the machine discharge section controls of pneumatic valves in the pneumatic circuitry to effect the desired momentary and short distance lift of the head beam to unload the back end of the exiting carton.

Figure 1:
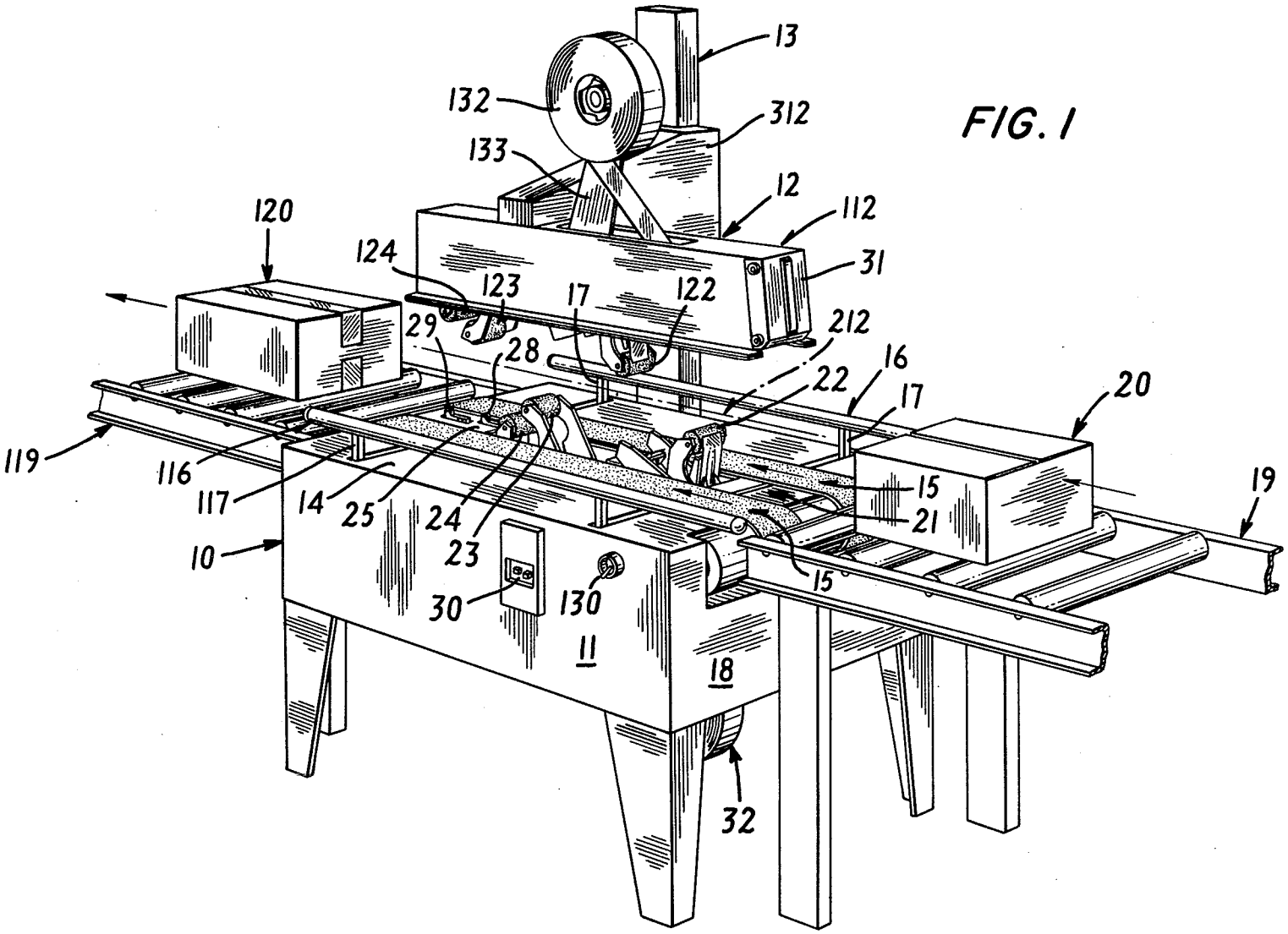
FIG. 1 is a perspective view of a carton taping machine in which side clamping rails and elevator head operating mechanisms and controls therefor of the present invention are embodied.

The carton sealing machine which embodies the pneumatic circuitry that includes the present invention is illustrated at 10 in the FIG. 1 perspective view, wherein it is indicated that it includes a lateral base structure 11 and an elevator head beam structure 12 with the latter supported, for slidable up-and-down movement, on a vertical column 13 that is mounted on the back side of the base structure.

The base structure 11 is provided with a substantially horizontal top panel 14 over which are driven the top runs of a pair of transversely-spaced, endless, carton-transporting belts 15. Above the base top panel 14 is supported a pair of longitudinally-extending carton-clamping side rails 16 and 116, with each suitably supported by upstanding arms 17 and 117 that are free to be moved transversely in slots in this top panel by equipment within the base structure which will cause the side rails to move alternatively and simultaneously toward and away from each other. Such side rail driving equipment may be any suitable powered means and preferably can be a pneumatic cylinder motor connected to the support structure of one of these side rails for moving it inward and outward sideways, and with the opposed side rail support structure being connected thereto by suitable linkage.

As is indicated in FIG. 1 the entrance end 18 of the base structure 11 may be preceded by a suitable roller table 19 on which an attendant may rest an empty carton with its bottom end flaps and side flaps folded inwardly for closure thereof to allow such attendant to load the carton chamber and then infold the top end flaps and side flaps, as is indicated at 20, all in well-known manner. The exit end of the machine bed 11 may also be equipped with a roller table 119 for receiving a loaded carton 120 after application of strips of sealing tape thereto.

Between the laterally-spaced top runs of the pair of transporting belts 15 the central zone of the machine bed 11 is cut away or provided with a longitudinal slot into which a tape applying mechanism cartridge 21 is inserted downward for suitable anchorage in a position to expose above the top panel 14 its three cylidrical wipe-on or applicator rollers 22, 23, and 24 for successive engagement by the loaded carton 20 as it is transported forward by the endless transporting belts 15. Beyond the exit end of this tape applying cartridge unit 21 this base top panel also supports a control unit 25 which carries a pair of controls 26 and 27 (FIG. 2) that are mechanically manipulated respectively by triggers 28 and 29 which extend upwardly into the path of the bottom portion of the forwardly transported loaded carton, for successive depression thereof to manipulate these control valves in sequence.

Figure 3:
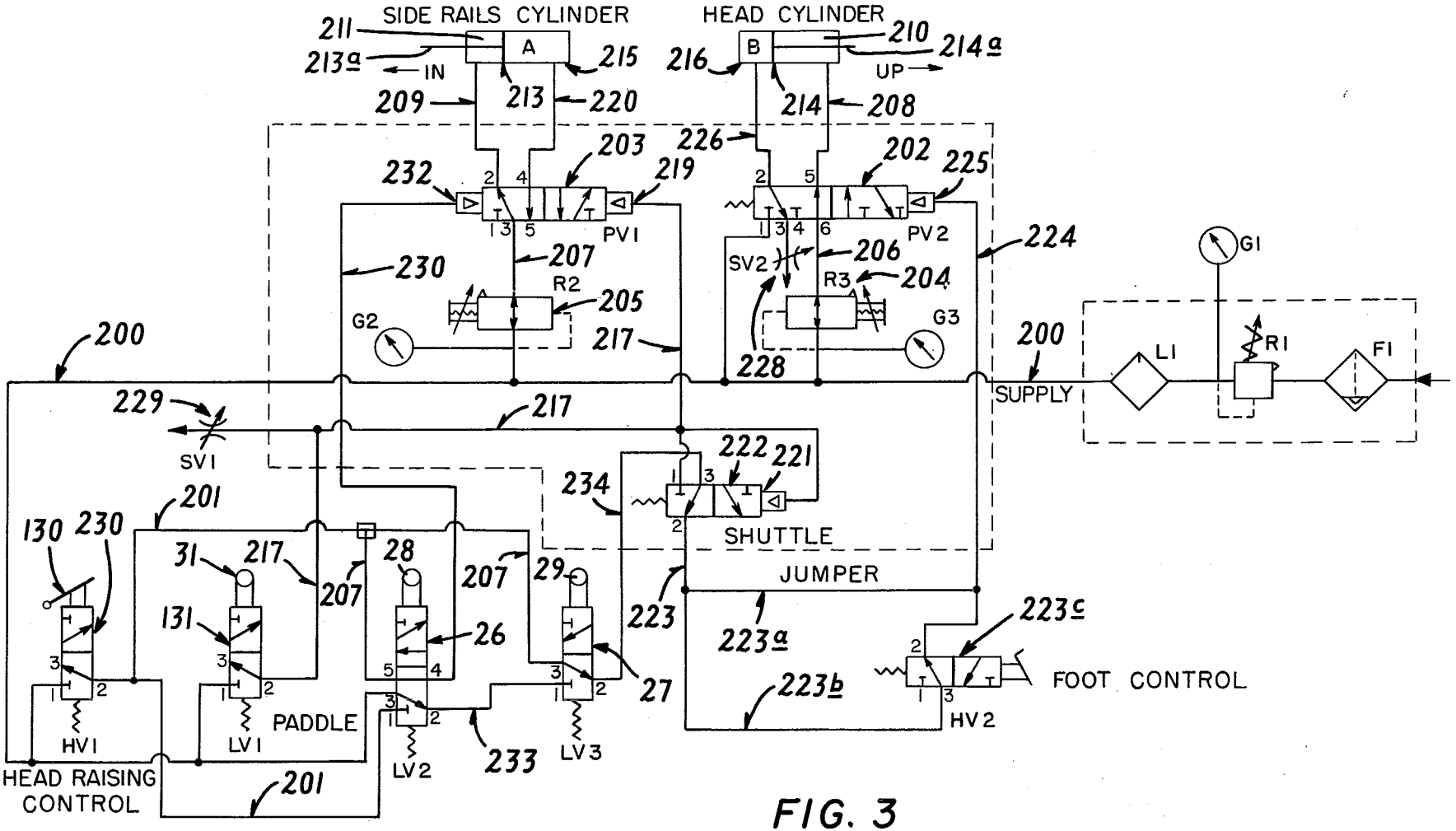
FIG. 3 is a schematic layout of the pneumatic circuitry and equipment embodied in the taping machine of FIG. 1.

The entrance end of the machine base structure 11 is provided at a convenient point with a manually operable push-button control 30 which activates the machine for operation. At such time the beam 112 of the elevator head 12 will be lowered to its lowest position, such as for example, to an elevation as is illustrated by the broken center line 212 (FIG. 1), so that a hinged end panel 31 which is carried by the approach end of this head beam will be abutted by the leading end wall of the oncoming carton 20 for manipulation of a pneumatic valve (131 of FIGS. 3 and 4). Manipulation of this valve causes the head beam to be raised clear of the top of such oncoming carton until this control 31 is freed for stopping the rise of the head beam at the top of such forwardly traveling carton. In this manner the head beam 112 is cleared from the path of the oncoming carton and is then permitted to rest down upon or load the top of such carton during its forward travel so that the manipulative action of the application of the tape, drawn from its supply roll 32, to the leading and trailing end walls and the bottom of the carton by the tape applying rollers 22, 23, and 24 will not cause any portion of the carton to rise from the transport belts 15 and interfere with the proper application of the tape. Mechanism cartridge 21 supports supply roll 32 by means of bracket arm 33 (FIG. 2). Bracket arm 133 serves the same purpose with respect to tape supply roll 132, for support of the top mechanism cartridge supported in head beam 112, with the latter mounted by elevating bracket 312 upon column 13.

As the carton 20 is advanced by the traveling belts 15 from the entrance end of the machine and beneath the loading head beam 112, such as forward from the position shown in FIG. 2, the tape applying rollers 22, 23, and 24 and 122, 123, and 124 of the bottom and top tape applying cartridges apply strips of tape against the leading and trailing carton end walls and longitudinally along the bottom and top of the carton, finally to reach a forward position substantially beyond the tape applying mechanisms and for successive depression of the pneumatic valve triggers 28 and 29. By reference to the schematic layout of the pneumatic circuitry and equipment shown in FIG. 3 it can be understood from the following explanation that the desired carton processing operation may be of the desired and advantageous type.

Assume that it is desired to run the tape applying machine 10 for successively processing therethrough the random sized loaded cartons, one of which is shown by way of example at 20, as their top flaps are folded down by the operator by hand and fed consecutively into the machine entrance end for pick-up by the pair of traveling endless bed belts 15. For this purpose the manually controlled head raising shifter valve 230 (HV1) on the entrance end of the machine bed structure 11 will be set manually by its trigger 130 in a position that prevents pressurized air in "SUPPLY" conduit 200 which is connected to its shifter side port No. 1, to flow across the core of this valve to its side port No. 2 and thence out through conduit 201 connected to the latter.

There is a flow path for conduction of pressurized air from "SUPPLY" conduit 200 to the Head Cylinder shifter valve 202 (PV2) and Side Rails shifter valve 203 (PV1) only through pressure regulators 204 (R3) and 205 (R2) respectively. Pressurized air will flow through conduit 206 from regulator 204 to side port No. 6 of head shifter valve 202 and across its core to side port No. 5 for flow through conduit 208 into the chamber 210 on the thrust rod side of the thrust head 214 in the Head Cylinder 216, so as to lower and hold down the machine head 12. At this same time pressurized air flows from regulator 205 (R2) through conduit 207 to side port No. 3 of side rails shifter valve 203 (PV1) and across its core to side port No. 2 for flow through conduit 209 into the chamber 211 on the thrust rod side of the thrust head 213 in the Side Rails Cylinder 215, so as to spread and hold spreaded the side rails 16 and 116 for reception of a loaded carton therebetween.

The processing of each single loaded carton through this taping machine as the operator pushes it forward, with its top flaps folded down in lapped closing position, to between widely spread entrance ends of the side rails may be described as follows. The carton enters the machine and abuts the pivoted paddle 31 on the approach end of the head beam 112 that is in its lowest position, so as to depress this pivoted paddle to depress the spring biased core of the shifter valve 131 therebehind (FIG. 4). At this time the main pressurized air from "SUPPLY" line 200 flows from side port No. 1 to side port No. 2 (now connected thereto) of the core of shifter valve 131 and also flows along conduits 217 to a (PV1) pilot valve end port 219, which will shift the core of valve 203 (PV1) to connect to the pressurized "SUPPLY" line 200 through pressure regulator 205 (R2) and now interconnected side ports No. 3 and No. 4 of valve 203 and on through conduit 220 to the Side Rails Cylinder end chamber A so as to cause the thrust of its piston head 213 and rod 213*a* to close the side rails 16 and 116 toward each other for guidance contact of opposite sides of the forwardly traveling intervening carton. This pressurized air also flows to pilot end port 221 of "SHUTTLE" valve 222 which will move its valve core to allow the air pressure to flow across this core from its side port No. 1 to its side port No. 2. This pressurized air also flows through the air conduits 223, jumper 223*a* and 224 to the pilot port 225 of the Head Cylinder valve 202 (PV2), which will shift the core of this valve and allow the pressurized air to flow from port No. 1 to port No. 2 thereof and through conduit 226 to the chamber B behind the piston head 214 of this Head Cylinder valve. Consequently this head pushes its thrust rod 214*a* and the head beam 112 carried thereby up to the point where the paddle operator 31 of shifting valve 131 (LV1) is raised from contact with the leading end of the carton whereby this paddle and this valve core are freed so that the latter is spring returned to its original position shown in FIG. 3. If it is desired to employ and utilize a make-and-break "Foot Control" 223*c* for flow connection between the output of "SHUTTLE" valve 222 and pilot valve 225 of Head Cylinder shifter valve (PV2) jumper conduit 223*a* will be closed.

As the core or shifter of paddle valve 131 (LV1) is raised with the head beam 112 above contact with the top of the entering box and the paddle 31 is thus released for spring return to its original position, the air supply from side port No. 1 to side port No. 2 of the core of this (LV1) shifter valve is cut off so that the shifter core of the Head Cylinder valve 202 returns to its initial position to shift connection of its side port No. 2 to side port No. 3, for optional exhaust of Head Cylinder chamber B through a flow controlled bleed-off exhaust valve 228 (SV2). Thus the fluid or air pressure that has shifted the (PV2) valve core exhausts back through the "SHUTTLE" valve 222 and out of a flow controlled bleed-off exhaust valve 229 (SV1). This permits the head beam 112 to drop down by gravity force on top of the carton as the carton begins to travel through the machine by means of the urging of the driven endless belts 15.

If desired, flow connections which may now be obvious may be added and employed either to supplement this gravity loading of the head structure down upon a carton top by some fluid or air pressure, or to offset some of it to lighten the head beam loading by suitable variance in the pneumatic circuitry. For example, the head beam 112 and the associated structure of head 12 may be caused to be lowered quickly downward to the top of the carton and apply a moderate pressure thereto. This is available by virtue of the fact that in Head Cylinder shifter valve 202 (PV2), upon spring return of its shifter core, the connection between side ports No. 1 and No. 2 is cut off and connection of side ports No. 2 and No. 3 is effected to exhaust chamber B of Head Cylinder 216. At this time the shifted core of Head Cylinder valve 202 (PV2) has connected side ports No. 5 and No. 6 to supply pressurized air through conduit 208 to the opposite side of the cylinder piston head 214 which accomplishes this desired operation.

As each loaded carton, such as that at 20, is carried forward to the discharge end of the machine bed 11 it trips the trigger 28 of the first control shifter valve 26 (LV2) to shift its core for connecting its side port No. 3 to its side port No. 4 for feeding a surge of pressurized air through conduit 230 to the other pilot end port 232 of the Side Rails Cylinder valve shifter 203 (PV1), thereby pushing the valve core of the later back to its original position which will allow the pressurized "SUPPLY" air again to flow through regulator 205 (R2) and conduit 220 of the Side Rails Cylinder 215 to behind the piston head 213 thereof so as to separate the side rails 16 and 116. Now the carton continues to travel over this first trigger 28 as the shifting core of control valve 26 (LV2) is held depressed by it and toward the trigger 29 of the second control shifter valve 27 (LV3). The distance along the lateral machine bed top 14 between these triggers 28 and 29 of these shifting valves 26 (LV2) and 27 (LV3) is relatively short. This distance may be about 5 inches and, therefore, the cores of the control (LV2) and (LV3) during the forward travel of the loaded carton will at a certain time be depressed simultaneously. When this simultaneous depression of triggers 28 and 29 of these control valves is attained side port No. 3 of control valve 26 (LV2) remains connected to side port No. 4 thereof so as to continue to apply pressure at the pilot end port 232 of shifter valve 203, so that pressure of the pressurized air from "SUPPLY" conduit 200 and regulator 205 (R2) through the core of this shifter valve and its feed conduit 209 leading to the piston rod side chamber 211 in front of the piston head 213 of the Side Rails Cylinder 215 is continued for holding the side rails separated. At this same time the simultaneous depression of trigger 29 has caused side port No. 3 of trigger valve 27 (LV3) to become disconnected from its side port No. 2 with cross connection now being established through the core of this trigger valve between its side ports Nos. 1 and 2 thereof to connect conduit 233 to conduit 234. Also, at this time side port No. 1 of trigger valve 26 (LV2) has no connection to a source of pressurized air. As soon as the bottom edge of the trailing end of the advancing carton 20 passes beyond the trigger 28 of the (LV2) trigger valve 26 so that its shifter core is spring returned to its initial position the supply of pressurized air to its side port No. 2 is restored while the trigger 29 of the (LV3) trigger valve 27 is still held depressed, so that this pressurized air travels through the conduit 233 to side port No. 1 of this trigger valve 27 which enables this valve to provide a surge of air through conduit 234 to side port No. 3 of the "SHUTTLE" valve 222. This surge of pressurized air travels through the "SHUT- TLE" valve core from its side port No. 3 to its side port No. 2 and through conduit 223 to conduit 224 by way of conduit 223a which will trigger with pressurized air the pilot end valve 225 of the Head Cylinder shifter valve 202 (PV2) to thrust its core for connection of its side port No. 1 to its side port No. 2 and allowing pressurized "SUPPLY" air to flow through the conduit 226 momentarily into piston chamber B. This raises the head beam 112 of the machine momentarily and to a limited extent until the trigger 29 of the (LV3) trigger valve 27 is soon released by exit of the taped carton to reverse the action of the head cylinder for lowering the head beam and its valve control paddle 31 again to its lower position, i.e., into the carton transport path. This eliminates a previous tendency of prior art operation for the head beam, which is resting on the forwardly moving carton, to apply a downward pressure on the back end of the exiting carton that may cause its leading front end to flip up and possibly cause the carton to fall off of the travel path or drop to the floor with attendant damage.

It will be seen in FIG. 5 that the momentary lift of the head beam 112 caused a desired gap 250 between the top of the back end of the carton 20 and the bottom face 412 of this head beam as the carton back end traveled forward to free the first valve trigger 28 while keeping the second valve trigger 29 depressed. The third tape applicator roller 124 of the head beam tape applying mechanism cartridge does momentarily retain contact with the carton back end top until the latter moves forward from therebeneath, but the downward biasing of this roller is by means of a lightly biasing sear-like spring similar to that at 51 in FIG. 2 and which will not cause tipping of the loaded carton as the top back end edge thereof moves forward from beneath this lightly biasing roller.

The bottom tape applying mechanism unit 21 pivotally supports arms 34, 42, and 50 which respectively carry tape applying rollers 22, 23, and 24, with spring 51 biasing arms 42 and 50 toward each other at pivot 43.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

We claim:

1. A tape sealing machine elevator head control equipment which avoids tipping up a loaded and tape-sealed carton as it is being advanced to the machine discharge end for withdrawal of its trailing end from beneath the lowered elevator head which bears by forces including gravity down on the flaps closing top of this carton during the application of the tape thereto, comprising 1. powered means to raise the elevator head above the forward travel path of said flaps closing carton top and then to dictate the gravity loading thereof down on the carton top as the carton is being advanced through the machine for application of tape thereto, and
2. control means responsive to the forwardly traveling carton in the vicinity of the machine discharge end section to activate said powered means for raising the elevator head up from the taped carton top for a relatively short period of time sufficient to relieve the carton back end of the load of the head as this carton back end is withdrawn from therebeneath and then as this taped carton travels beyond said head, drop the latter back down to its initial position for cooperation with the succeeding carton.

2. The elevator head control equipment as defined in claim 1 characterized by said powered means to manipulate said elevator head being a pneumatic motor and associated pneumatic circuitry equipment including said control means.

3. The elevator head control means as defined in claim 2 characterized by said control means being in the form of pneumatic valve means in said pneumatic circuitry equipment and control trigger means for manipulating said valve means in response to movement of a carton through the machine discharge section.

4. A tape sealing machine elevator head control equipment which avoids tipping up a loaded and tape-sealed carton as it is being advanced to the machine discharge end for withdrawal of its trailing end from beneath the lowered elevator head which bears by forces including gravity down on the flaps closing top of this carton during the application of the tape thereto, comprising a pneumatic motor and associated pneumatic circuitry equipment to raise and lower the elevator head and to dictate the loading thereof down on the carton top as the carton is being advanced through the machine for application of tape thereto, and control means responsive to the forwardly traveling carton in the vicinity of the machine discharge end section in the form of pneumatic valve means in said pneumatic circuitry equipment to activate said motor and circuitry equipment for raising the elevator head up from the carton top for a relatively short period of time sufficient to relieve the carton back end of the load of the head as this carton back end is withdrawn from therebeneath, said control pneumatic valve means being in the form of a pair of first and second trigger valves with their triggers successively arranged along the discharge end section of the machine carton path for contact manipulation successively by each passing carton whereby a surge of pressurized air first is supplied to said pneumatic motor momentarily to raise said head up from the passing carton and then this head is lowered to its initial position after discharge of the taped carton for repeat with a following carton.

5. The elevator head control means as defined in claim 4 characterized by said pair of trigger valves being connected in said pneumatic circuitry in a manner whereby triggering of the first valve by contact with the advancing carton occurs before the trigger of the second valve is triggered by the further advancing carton to assure freedom of the advancing carton to exit from the machine and when the trigger of the first valve is freed and the second valve is triggered the raising of the head momentarily is effected.

* * * * *

UNITED STATES PATENT AND TRADEMARK OFFICE

CERTIFICATE OF CORRECTION

PATENT NO. : 4028865

DATED : June 14, 1977

INVENTOR(S) : Saul Warshaw, Winton Loveland, and Horst J. Hanemann

It is certified that error appears in the above-identified patent and that said Letters Patent are hereby corrected as shown below:

Abstract page:

"[75] Inventors: Winton Loveland, Fort Salonga; Horst J. Hanemann, Manhasset, both of N.Y.; Saul Warshaw, Hawley, Pa." read --[75] Inventors: Saul Warshaw, Hawley, Pa.; Winton Loveland, Fort Salonga; Horst J. Hanemann, Manhasset, both of N.Y.--;

Column 2, line 45, "type" should read --types--; column 3, line 49, for "cylidrical" read --cylindrical--; column 6, line 24, for "later" read --latter--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*